US007098886B2

(12) United States Patent
La

(10) Patent No.: US 7,098,886 B2
(45) Date of Patent: Aug. 29, 2006

(54) FLAT PANEL DISPLAY

(75) Inventor: Kwang-Hyun La, Anyang (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 376 days.

(21) Appl. No.: 10/157,994

(22) Filed: May 31, 2002

(65) Prior Publication Data

US 2002/0180718 A1 Dec. 5, 2002

Related U.S. Application Data

(60) Provisional application No. 60/295,021, filed on Jun. 4, 2001.

(51) Int. Cl.
*G09G 3/36* (2006.01)

(52) U.S. Cl. ..... 345/99; 345/204; 345/205

(58) Field of Classification Search ..... 345/99, 345/100, 87, 88, 89, 90, 91, 92, 93, 94, 95, 345/96, 204

See application file for complete search history.

(56) References Cited

U.S. PATENT DOCUMENTS

| | | | | |
|---|---|---|---|---|
| 5,276,458 | A | 1/1994 | Sawdon | |
| 5,394,166 | A * | 2/1995 | Shimada | 345/98 |
| 5,908,997 | A * | 6/1999 | Arnold et al. | 84/615 |
| 6,281,944 | B1 * | 8/2001 | Kim | 348/674 |

FOREIGN PATENT DOCUMENTS

| | | | |
|---|---|---|---|
| EP | 0 697 688 | A1 | 2/1996 |
| EP | 0 856 829 | A2 | 1/1998 |
| EP | 0 856 829 | A2 | 8/1998 |
| EP | 1 032 200 | A2 | 2/2000 |
| EP | 1 032 200 | A2 | 8/2000 |

OTHER PUBLICATIONS

S6B0755, 128 SEG/65 COM Driver & Controller for STN LCD, Preliminary SPEC. VER. 1.0, Samsung Electronics, Jun. 2000, XP002211548.

European Search Report dated Sep. 18, 2002.

* cited by examiner

*Primary Examiner*—Richard Hjerpe
*Assistant Examiner*—Jean Lesperance

(57) ABSTRACT

The present invention is directed to a flat panel display device and a method for driving thereof. According to the present invention, in the flat panel display for processing and displaying a display signal outputted from the graphic source via a serial bus, the graphic source fetches and interprets the display characteristics information of the flat panel display from the flat panel display module via the serial bus so that a new corresponding standard of display signal can be outputted. Here, the display characteristics information is adjustable by the input of predetermined data by use of a predetermined key installed outside the flat panel display by a user and includes more than one of standard information of the display signal with its blanking interval defined and screen display information. A flat panel display according to an embodiment of the present invention is essentially comprised of a graphic source including a graphic source unit; and a liquid crystal display module including a connector, a D/A converter, a memory, and a timing controller.

6 Claims, 4 Drawing Sheets

FLAT PANEL DISPLAY

CROSS REFERENCE TO RELATED APPLICATION

This Application is based on U.S. Provisional Application No. 60/295,021 filed on Jun. 4, 2001, herein incorporated by reference in its entirety.

BACKGROUND OF THE INVENTION (a) Field of the Invention

The present invention relates generally to a flat panel display, and more particularly to an apparatus and a method for driving the flat panel display.

(b) Description of the Related Art

A typical flat panel display in commercial use includes a liquid crystal display (LCD) and a plasma display panel (PDP) and, in addition, such display as an electro luminescence (EL) has been developed.

A flat panel display module has a flat panel in which pixels are arranged in a matrix form between two glass substrates, a PCB (printed circuit board) module for driving the flat panel, and a case for protecting and integrating them.

As shown in FIG. 1 illustrating an entire circuit configuration of a typical flat panel display module, the PCB module for driving the flat panel 40 typically includes a main PCB 10 for receiving RGB image data, synchronization signals, etc., from an external apparatus like a PC. Such signals are processed by a timing controller T-con, a customized integrated circuit in the form of FPGA (flat pin grid array), so that image data and a variety of control signals are produced in accordance with structure of the flat panel 40. It also includes a row driver 20 for supplying scanning signals for row signal lines based on row driver control signals 50 and power signals 51 received from the main PCB 10, and a column driver 30 for supplying gray level voltages 61 for the flat panel 40 after receiving the image data and the control signals 60 processed in the main PCB and the gray level voltages 61.

However, as conventional driving circuits implemented on the main PCB 10 have a masking timing setting scheme that combines timing and various input driving interface conditions within a specification prescribed for the panel, it is impossible to modify timing and operation of the driving circuits depending on the changes of user conditions and input conditions of display source and monitor product. In other words, the timing and operation of the driving circuits are fixed, and even within a range of possible operation, it is impossible to flexibly support the optimization of display characteristics unless processed by a hardware option in the driving circuits. This is because the timing conditions for input of the flat panel display is basically set to be suitable for VESA specification, and allows a graphic source to produce and display digital interface timing control signals for driving the panel on the basis of digital data communication (DDC) information stored in the flat panel display module. In addition, flat panel display monitor products on the market set gamma voltages and various power sources for differentiating gray.

According to the conventional art, a user can adjust gamma voltages, flicker voltages, brightness, scaling, frame rate control (FRC), I/O format, etc., by identifying and adjusting a screen display state using an On Screen Display (OSD) function or directly adjusting a hardware. However, only by using these functions, although an optimal screen can be driven by modifying timing (modifying a driving frequency or modification to least and optimal blanking time) on the flat panel driving circuit or a very good driving environment can be achieved by processing a standard signal through an additional circuit in the graphic source so that the driving frequency is modified or the modification to the least and optimal blanking time is made, as referred to above, as an I/O format is required to satisfy the requirement to a general display standard, however good the above conditions may be, a risk to the modification is very high.

In addition, particularly, an interface is required to drive a different I/O format of display source for use in a monitor, and if a difference occurs in a frame frequency or the number of blanking interval, an additional system board (such option board as A/D board, D/D board, etc.), which is capable of FRC adjustment, should be supported. Furthermore, the I/O format of the flat panel display is limited and efficiency of the display products cannot be fully facilitated. Furthermore, a jitter caused by the option board and a mismatch of bi-directional interface conditions result in poor picture quality. It neither contributes to optimizing the monitor products.

As described above, a difference in display manner from a CRT display and the flat panel display causes this problem. The CRT can drive widely up to from 40 Hz to 85 Hz in the frame frequency while the driving manner of the flat panel display is determined by the characteristics of the panel. In other words, if the characteristics of the current panel is optimized at the frame frequency of 60 Hz, the driving conditions also becomes necessarily optimized at 60 Hz. In addition, since a graphic card or the display source does not exactly follow a VESA standard, different manufacturers supply data of various timing slightly different from standard timing. Therefore, when the timing for the optimal driving conditions of the flat panel should be different from the timing of the VESA standard signal or a slight deviation occurs in the standard signal dependent on manufacturers, though an additional option board is used in order to adjust such a changeable timing, this is insufficient to perform completely the function described above and the additional board incurs a high cost.

In addition, a blanking interval (horizontal synchronization signal, back porch, front porch)) taken to return to the next line after line of electron beam is scanned with the standard of input timing of VESA display as the CRT standard and a blanking interval (vertical synchronization signal, back porch, front porch) taken to return from last position, where one frame is scanned, to first position are specified for each frequency. However, since an active matrix scheme and the like other than a scanning scheme are used in driving the flat panel, after transfer of last display signal of line or frame, a blanking interval may have only a blanking interval of as much as least pixel (in case of a horizontal blanking) or line (in case of a vertical blanking), unlike the CRT. In addition, by using such option board as an A/D board, when the operation frequency is increased and the blanking interval becomes long and unstable so that an interface process or an I/O becomes unstable due to an unnecessary blanking interval in the VESA conditions, the driving conditions of the flat panel also becomes considerably unstable. Accordingly, there is a need that the flat panel can be driven on optimal driving timing conditions by reducing the blanking time described above so that display characteristics becomes stable and reliable.

In addition, there is a case that the display characteristics should be adjusted based on product tolerance or user environment and conditions. As these flat panel monitor products are conventionally set with the optimal driving conditions determined by the characteristic of the flat panel, an adjustment should be made by an additional option board or an interface board. However, by adjustment of gamma, contrast, brightness, flicker, and other display characteristics, when the optimal driving conditions fixed in accordance with characteristic of the flat panel is modified, there were the problems that the flat panel characteristics can be used with 100% efficiency since contrasted upper and lower gray levels are fitted to the flat panel in a truncated state by clamping when the A/D board or the option board is used.

Therefore, there is a desirable need to provide an essential driving scheme that eliminates cost rise due to the option board as well as prevents the jitter caused by the mismatch of interface conditions. In other words, there is a need to facilitate the modification to FRC, I/O format, and other information on the display characteristics so that resolution information, information on such operation frequency as vertical and horizontal frequency of the picture signal and main frequency of the picture signal, as well as digital information on gamma voltage, flicker voltage, and brightness and the like can be shared by the graphic source and the flat panel display module can be updated by users. Particularly, there is a need to utilize the signal outputted from the graphic source to the maximum so that it is adapted to the driving of the flat panel display device by using the signal as the standard signal as well as the picture signal modified in its blanking interval and then its frequency based on a definition by the user.

SUMMARY OF THE INVENTION

In considerations of the above problems, it is an object of the present invention to provide a flat panel display having a wide and flexible interface such that I/O timing and other display characteristics can be stored and shared in the driving apparatus and an adjustment and an upload are feasible using a serial bus with a VESA standard DDC function without an additional option.

To achieve these objects, according to an aspect of the present invention, a flat panel display for processing and displaying a display signal outputted from the graphic source via a serial bus comprises, a memory shared with the graphic source for storing display characteristics information of the flat panel adjustable by a user; a D/A converter for converting a predetermined screen display information included in the display characteristics information of the flat panel to an analog signal; and a timing controller for receiving and calculating a display signal outputted from the graphic source via the serial bus and outputting the display signal to drive the flat panel.

Preferably, the display characteristics information of the flat panel is adjustable by a predetermined signal outputted from the graphic source to the serial bus, corresponding to the input of predetermined data by use of a predetermined program by a user. Preferably, the display characteristics information is adjustable by the input of predetermined data by use of a predetermined key installed outside the flat panel display by a user.

Preferably, the display characteristics information of the flat panel includes more than one of standard information of the display signal with its blanking interval defined and screen display information.

With the above construction of the present invention, in the flat panel display for processing and displaying a display signal outputted from the graphic source via a serial bus, the graphic source fetches and interprets the display characteristics information of the flat panel from the flat panel display module via the serial bus so that a new corresponding standard of display signal can be outputted. Here, the display characteristics information is adjustable by the input of predetermined data by use of a predetermined key installed outside the flat panel display by a user and includes more than one of standard information of the display signal with its blanking interval defined and screen display information.

According to another aspect of the present invention, a method for driving a flat panel display for processing and displaying a display signal outputted from the graphic source via a serial bus comprises the steps of: outputting a predetermined signal from the graphic source corresponding to the modification and input of the display characteristics information of the flat panel by use of a predetermined program by a user; modifying the display characteristic information of the flat panel stored in a flat panel display module by use of the predetermined signal outputted from the graphic source; fetching and interpreting in the graphic source the display characteristics information of the flat panel from the flat panel display module via the serial bus; and outputting a new corresponding standard of display signal from the graphic source depending on a result of the interpretation.

Preferably, the method for driving a flat panel display further comprises modifying the display characteristics information by the input of predetermined data by use of a predetermined key installed outside the flat panel display by a user.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENT

Preferred embodiment of the present invention will now be described in detail with reference to the accompanying drawings.

Figure 1:
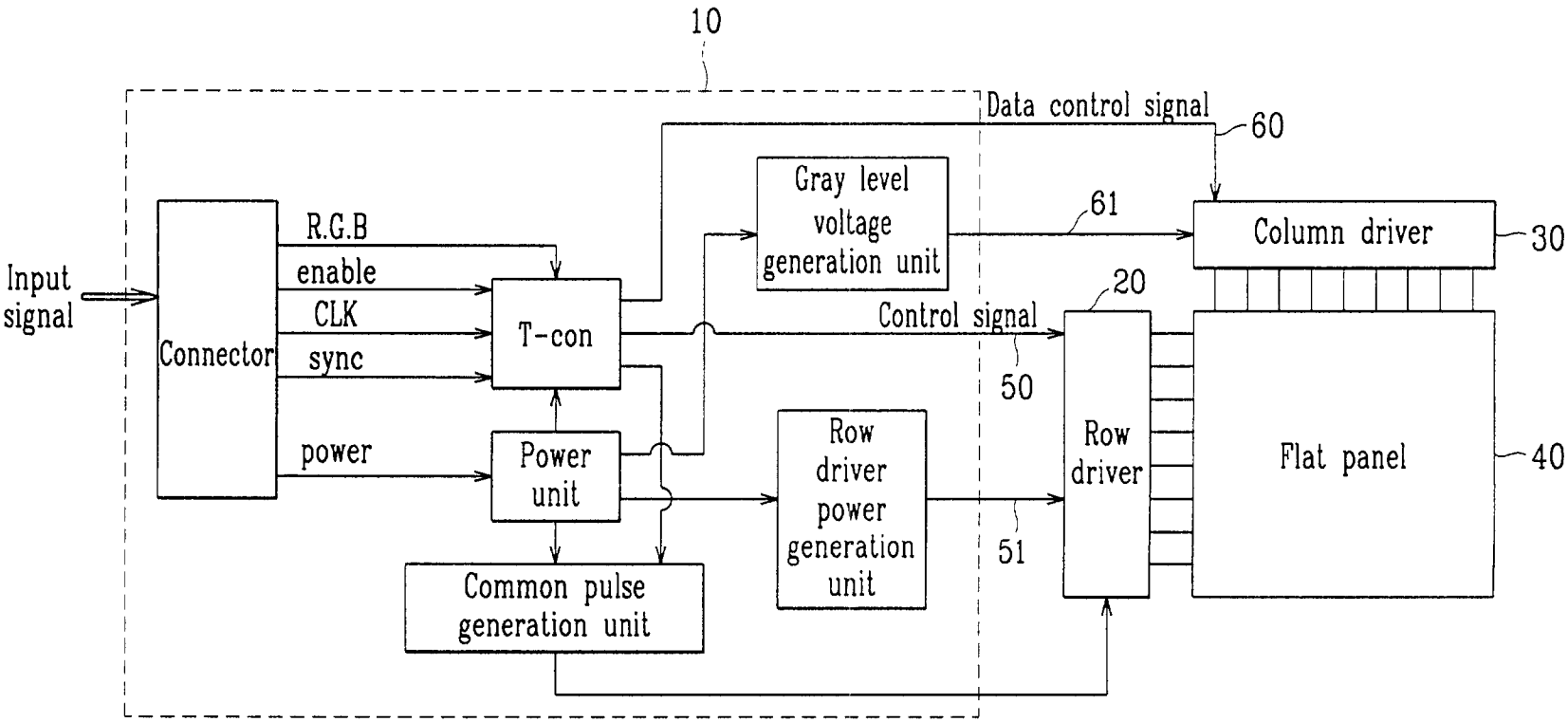
FIG. 1 shows a block diagram for illustrating an entire configuration of a typical flat panel display module.
Figure 2:
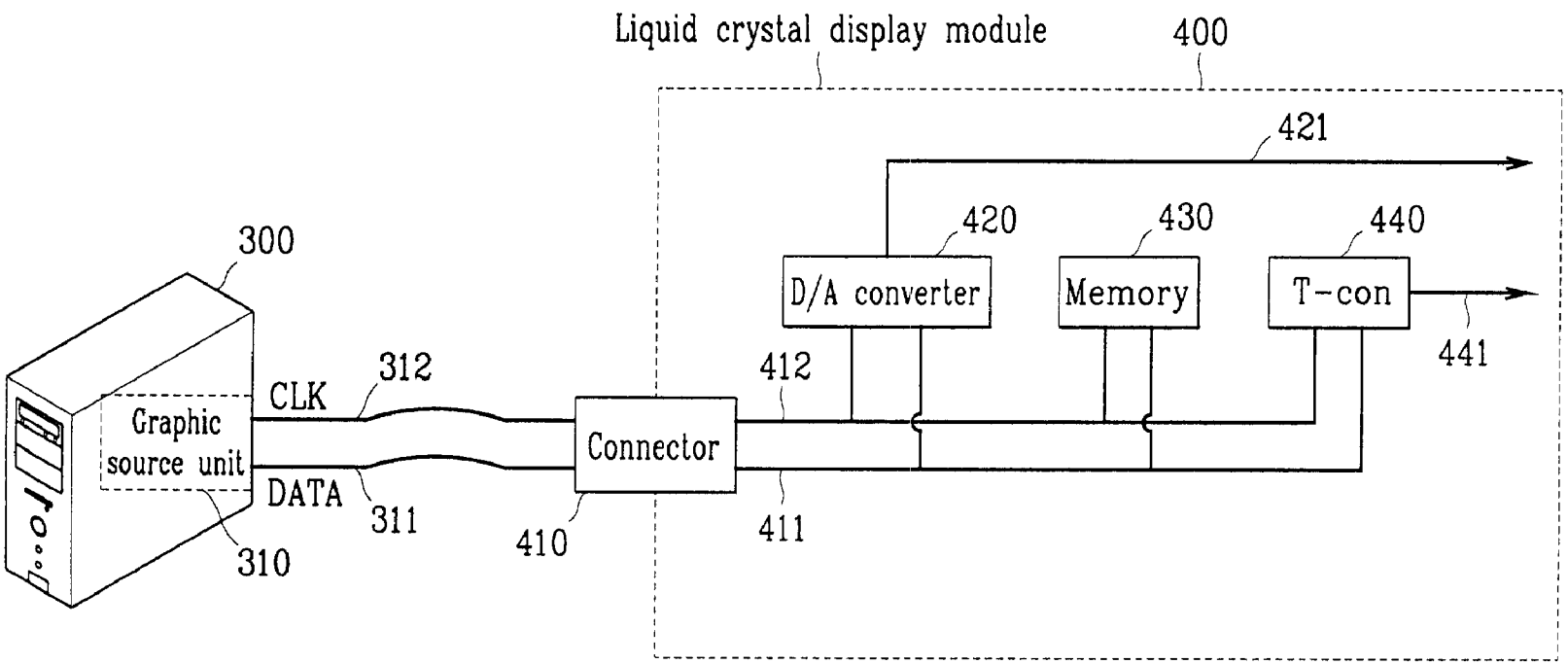
FIG. 2 shows a block diagram for illustrating the graphic source and the flat panel display module in accordance with an embodiment of the present invention.

As shown in FIG. 2, a liquid crystal display(a flat panel display) according to an embodiment of the present invention basically includes a graphic source 300 including a graphic source unit 310, and a liquid crystal display module 400 including a connector 410, a D/A converter 420, a memory 430 and a timing controller 440. Here, the liquid crystal display according to the present invention can achieve the function of the conventional option board. Furthermore without the option board it can achieve more function than the conventional option board can do, thereby resulting in the cost reduction. In addition, although the conventional option board is not required in the present invention, its employment does not hinder all features of the present invention.

The graphic source unit 310 is a part of the graphic source 300 such as a PC main body or another system outputting picture signals and functions as an apparatus for generating and outputting synchronization signals, graphic signals and other control signals. Particularly, by fetching and interpreting the display characteristic information of the liquid crystal display panel (flat panel) from the flat panel display module via serial buses, the graphic source unit 300 outputs a new corresponding standard of display signal.

The connector 410 refers to a connector for serial buses such as a DVI (digital video interactive) or a D-SUB for receiving a display signal from the graphic source unit 310 of the graphic source 300 like the PC main body via cables 311 and 312.

The D/A converter 420 converts screen display information included in the display characteristic information of the liquid crystal panel stored in the memory 430 into analog signals. In other words, among the display characteristic information of the liquid crystal panel adjustable by a user, the screen display information such as gamma voltage, flicker voltages and brightness is received with digital data, and then converted into analog data to be provided for corresponding circuits of the PCB module. Here, a series of operation described above as well as the operation of the typical liquid crystal display is executed under the control of the timing controller 440.

The memory 430 stores the display characteristic information of the flat panel modifiable by a user and is shared with the graphic source unit 310. Here, the display characteristic information of the liquid crystal panel is the information on the standard of the liquid crystal panel, which contains the resolution and the operation frequencies such as vertical and horizontal frequencies of picture signals and a main frequency of a picture signal for driving the liquid crystal panel as well as the digital information on gamma voltage, flicker voltage, brightness, etc., adjustable by a user.

The timing controller 440 receives and processes the display signals from the graphic source unit 310 via the serial bus to output the display signals for driving the liquid crystal panel. In other words, the display signals of the liquid crystal panel such as picture signal, control signals, etc., corresponding to the display characteristic information of the liquid crystal panel is outputted to be provided for corresponding circuits of the PCB module.

Now, the operation of the liquid crystal display according to the embodiment of the present invention configured as described above will be described in detail.

First, unlike the CRT (cathode-ray tube) capable of driving with range of frame frequency from 40 Hz to 85 Hz, the driving method of the liquid crystal panel display is determined by the properties of the panel. If the characteristics of the current panel is optimized at the frame frequency of 60 Hz, the driving conditions of the timing controller 440 and other components are necessarily optimized at 60 Hz. In a typical monitor, the liquid crystal panel display module 400 receives signals from the graphic source 300, which are fixed in standard signals such as VESA, and processes them by means of the option board and the timing controller so that FRC or I/O format and other signals are adjusted to some extent. However, the signals outputted from the typical graphic source 300 has not adjusted themselves for FRC or I/O format and so forth. Particularly, since a long blanking interval is required only for scanning system of CRT, not for display of an active matrix system such as the liquid crystal panel display using digital signal processing, elimination of the long blanking interval to a maximal extent gives various advantages to the liquid crystal display panel.

In the liquid crystal display according to the embodiment of the present invention, an operation procedure for adjusting FRC or I/O format and so forth as well as the blanking interval by means of the signals themselves outputted from the graphic source without the option board is described.

The operation of the liquid crystal display according to the embodiment of the present invention as shown in FIG. 2 is described now.

First, when a power supply for entire operation, which is provided at the liquid crystal panel display module (or monitor) 400 connected to the graphic source 300 such as a PC main body and so forth via the cables 311 and 312 and the DVI or D-SUB connector 410, is turned on, the display characteristic information of the liquid crystal panel stored in the memory 430 is transmitted as DDC information to the graphic source unit 310 via the serial buses 411 and 412. The graphic source unit 310 interprets this information to provide various display signals corresponding to the result of this interpretation for the liquid crystal panel display module 400 via the cable 311 and 312.

At that time, unlike the conventional device, the display characteristic information of the liquid crystal panel is included in the DDC information shared between the graphic source unit 310 and the memory 430 of the liquid crystal panel display module 400. The display characteristic information of the liquid crystal panel can be modified by a user using predetermined application programs, and then the modified or updated information is re-stored in the memory 430. When the liquid crystal display is turned on next time, the graphic source unit 310 fetches and interprets the updated information in the memory 430. In other words, the user recommends the optimal conditions adaptable to the liquid crystal panel to the graphic source 300 so that the graphic source unit (PC or other display system) 310 can adjust directly an input timing.

Here, the display characteristic information of the liquid crystal panel modifiable by a user using the predetermined application programs includes FRC, I/O format, and other screen display (brightness, gamma, flicker, etc.) information shown on the screen, as described above. Particularly, since even the blanking interval present in standard picture signals is adjustable, the liquid crystal display module 400 operates by new standard picture signals other than VESA standard signals.

Figure 3:
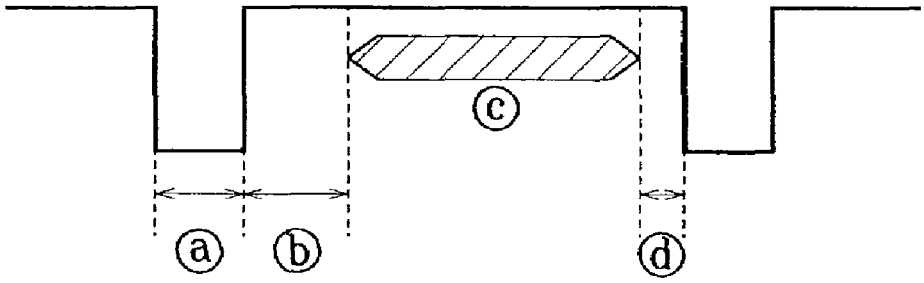
FIG. 3 shows an example of a display signal produced at the graphic source in accordance with a prior art.
Figure 4:
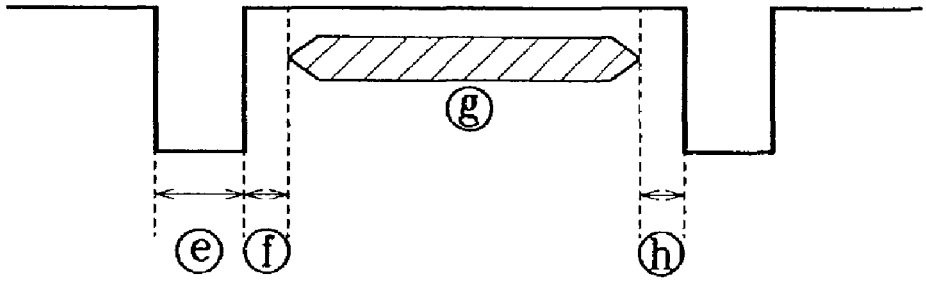
FIG. 4 shows an example of a display signal produced at the graphic source in accordance with an embodiment of the present invention.

In other words, a conventional display signal produced by the graphic source unit 310 includes a synchronization signal portion (ⓐ), a back porch (ⓑ), a portion carrying picture data (ⓒ) and a front porch (ⓓ). The back porch (ⓑ) is slightly longer than the front porch (ⓓ), as shown in FIG. 3. On the other hand, when the blanking interval is adjusted according to the embodiment of the present invention, a portion carrying picture data (ⓖ) is relatively long, and a synchronization signal (ⓔ), a back porch (ⓕ) and a front porch (ⓗ) occupy an appropriate portion as narrow as required for processing signals for driving the liquid crystal panel, as shown in FIG. 4. Adjusting the blanking interval using a predetermined application program means that the times for the standard information of the display signal, i.e., the portion carrying picture data (ⓖ), the synchronization signal portion (ⓔ), the back porch (ⓕ) and the front porch (ⓗ) are defined so that the graphic source unit 310 produces a new standard of display signal.

As described above, when the memory 430 is updated with new display characteristic information, the graphic source unit 310 fetches and interprets this information so that corresponding display signals are generated to be transmitted to the liquid crystal panel display module 400. At the time, as the transmitted display signals are shared by the D/A converter 420 and the timing controller 440 via the serial buses 411 and 412, the timing controller 440 produces various control signals and the picture signals required for driving the liquid crystal panel and provides them for the corresponding circuits of the PCB module via wires 441. The D/A converter 420 converts digital data for state of gamma, flicker, and brightness to provide for corresponding circuits of the PCB module via wires 421 under the control of the timing controller 440 based on the display characteristics information stored in the memory 430.

Figure 5:
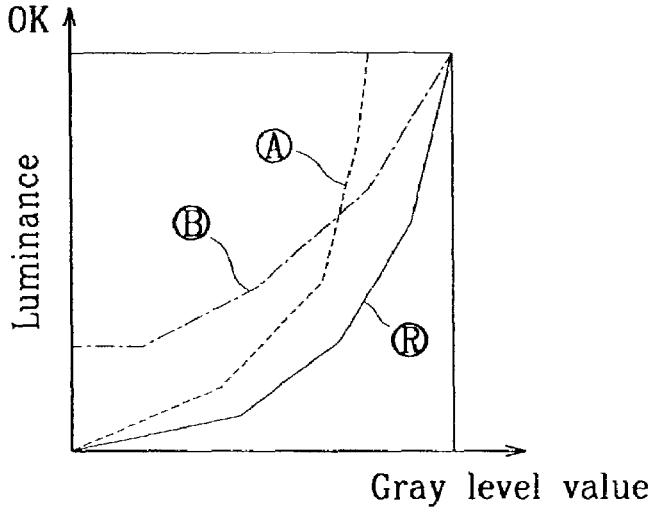
FIG. 5 shows a graphic diagram for a gamma variation when an option board is used in accordance with a prior art.
Figure 6:
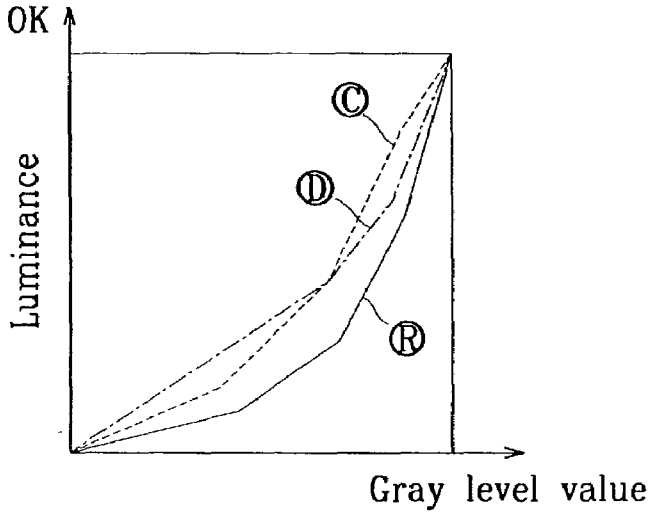
FIG. 6 shows a graphic diagram for a gamma variation when display characteristic is adjusted via a serial bus in accordance with an embodiment of the present invention.

As described above, when a user adjusts screen display (brightness, gamma, flicker, etc.) data representing display state of the screen using a predetermined application program, since the conventional OSD function can be implemented by digital processing without an additional option board such as an A/D board, unique gamma function of the liquid crystal panel can be utilized over an entire region. As shown in FIG. 5, when the conventional option board such as the A/D board is used, gray levels near the highest gray level are lost with respect to the standard gamma variation (R) when brightness is adjusted (A), and gray levels near the lowest gray level are lost when contrast is adjusted (B), depending on the circuit characteristics. However, according to digital processing of the present invention, although brightness (C) or contrast (D) is adjusted as shown in FIG. 6, the gamma variation approaching the standard gamma variation is maintained, and thus the display capability of the liquid crystal panel can be utilized to its maximum.

On the other hand, though a user can adjust the display characteristics information representing the display state of the screen using the predetermined application program, this can be also implemented in combination with input of a predetermined data from a user by using a preset key installed outside the liquid crystal display, as the OSD function is supported in all monitor.

As described above, according to the embodiment of the present invention, with the liquid crystal display for processing and displaying the display signals from the graphic source unit 310 via the serial buses, the graphic source unit 310 fetches and interprets the display characteristics information of the liquid crystal panel from the liquid crystal panel display module 400 via the serial buses so that new corresponding standard of the display signals can be outputted. Here, the display characteristics information of the liquid crystal panel is adjustable by the input of predetermined data from a user by using a preset key installed outside the liquid crystal display device as well as by the predetermined signal outputted from the graphic source unit 310 to the serial buses, corresponding to input of the predetermined data from a user byusing the predetermined program.

The description about the liquid crystal display according to the embodiments of the present invention is applicable to such general flat panel displays as plasma display panel (PDP) and organic electro-luminescent (EL) display having a driver in the PCB module similar to that of the liquid crystal display, in addition to the liquid crystal display.

As is apparent from the above description, with the driving of the flat panel display device according to the present invention, cost increase due to the use of the option board can be eliminated andjitter due to inconsistence of interface conditions can be essentially prevented.

Also, as the graphic card for display or the display source searches an I/O interfaced optimal conditions by fetching a driving conditions of the flat panel via the serial bus or $1^2C$ bus of an interface cable connector of DVI or D-SUB and the like with an I/O format information or transmits a setting value of an optimized conditions defined by an adjustment by a user or an I/O timing required by the display source to the flat panel so that a display timing required by the display source can be set, a graphic signal can be supported by any standard of timing conditions other than VESA. Particularly, with the same display resolution and the same frame frequency, the flat panel can be driven at a driving frequency lower than that of VESA standard, resulting in improvement of the display characteristics due to increased charge time for pixel display or time to spare for processing of pixel data.

In addition, when timing for an optimal driving conditions of the flat panel must be different from that of VESA standard signal or the standard signal has a slight deviation dependent on manufacturers, by adjusting freely input and output timings through serial bus ($I^2C$ bus, SPI bus, 3-wire bus, etc.) interfaces of the timing controller and sharing the information on timing by storage of data setting value into the memory storing DDC display information so that correct input/output information can be stored and continuously updated and a continuous adjustment can be made in the presence of variation of an external environment, it is possible to control DDC display information by changing the driving conditions without the additional option system (such as A/D board with Scaler, DSP, and FRC functions), resulting in securing characteristics on timing margin of monitor products.

In addition, gamma among the display characteristics is fixed at a target value by a fixed voltage generated by resistances or in a voltage-divided manner from the external. This makes gamma for the entire gray level not adjustable when contrast or brightness is adjusted by using the A/D board or other intermediate interface. However, the present invention allows a desired gamma adjustment with fully utilizing the brightness of the flat panel and without a change of gray level characteristics of products by freely setting a voltage through the serial buses.

Furthermore, values adjusted by a user or set by requirement of the graphic source are stored in a storage such as a memory shared through the serial buses so that state and information of the monitor product are shared and adjustable and an optimal display characteristics information is manageable by an upload/reload operation.

Although preferred embodiment of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A flat panel display for processing and displaying a display signal corresponding to display characteristics information outputted from a graphic source unit to the flat panel display via a serial bus, the graphic source unit being installed in an apparatus for generating and outputting the display signal including graphic signals and control signals, the display comprising:

a serial bus;

a timing controller directly connected to the serial bus for receiving the display signal outputted from the graphic source unit via the serial bus;

a memory, directly connected to the serial bus for connection to both the graphic source unit and the timing controller, for storing the display characteristics information adapted to the flat panel display; and a Digital-Analog converter, directly connected to the serial bus for connection to both the timing controller and the graphic source unit, for converting a plurality of digital gamma values based on the display characteristics information into a plurality of analog gamma values, wherein the timing controller outputs the digital gamma values to the Digital-Analog converter.

2. The flat panel display of claim 1, wherein the memory is a non-volatile memory.

3. The flat panel display of claim 2, wherein the memory is a EEPROM.

4. The flat panel display of claim 1, wherein the display characteristics information includes resolution information, frequency information, and gamma information.

5. The flat panel display of claim 1, wherein the timing controller produces a display data based on the display characteristics information and the display signal and outputs the display data to a row driver.

6. A method for driving a flat panel display for processing and displaying a display signal corresponding to display characteristics information outputted from a graphic source unit to the flat panel display via a serial bus, the graphic source unit being installed in an apparatus for generating and outputting the display signal including graphic signals and control signals, the method comprising:

receiving the display signal outputted from the graphic source unit via the serial bus;

storing the display characteristics information adapted to the flat panel display;

producing a display data based on the display characteristics information and the display signal and outputting the display data to a row driver; and receiving digital gamma values and converting the digital gamma values into analog gamma values.

* * * * *